US009516983B2

(12) United States Patent
Queen

(10) Patent No.: US 9,516,983 B2
(45) Date of Patent: Dec. 13, 2016

(54) WATER FOCUSING CLEANING HEAD

(71) Applicant: Dennis Queen, Brush, CO (US)

(72) Inventor: Dennis Queen, Brush, CO (US)

( * ) Notice: Subject to any disclaimer, the term of this patent is extended or adjusted under 35 U.S.C. 154(b) by 0 days.

(21) Appl. No.: 14/861,922

(22) Filed: Sep. 22, 2015

(65) Prior Publication Data

US 2016/0081524 A1 Mar. 24, 2016

Related U.S. Application Data

(60) Provisional application No. 62/053,309, filed on Sep. 22, 2014.

(51) Int. Cl.
*A47L 11/34* (2006.01)
*A47L 11/40* (2006.01)

(52) U.S. Cl.
CPC ..... *A47L 11/34* (2013.01); *A47L 11/4038* (2013.01); *A47L 11/4044* (2013.01); *A47L 11/4088* (2013.01)

(58) Field of Classification Search
CPC .. A47L 11/34; A47L 11/4038; A47L 11/4044; A47L 11/4088
See application file for complete search history.

(56) References Cited

U.S. PATENT DOCUMENTS 2,999,258 A 9/1961 Berberian
4,333,204 A * 6/1982 Monson ..... A47L 11/30 15/320
4,339,840 A * 7/1982 Monson ..... A47L 11/30 15/320
5,517,715 A 5/1996 Monson
6,032,326 A * 3/2000 Roden ..... A47L 9/02 15/320
8,453,293 B1 * 6/2013 Monson ..... A47L 11/292 15/320
9,107,557 B2 * 8/2015 Studebaker ..... A47L 11/302
2007/0251047 A1 * 11/2007 Monson ..... A47L 11/03 15/322
2008/0141483 A1 * 6/2008 Pearlstein ..... A47L 11/4038 15/320
2012/0023698 A1 2/2012 Durrant et al.
2012/0054981 A1 3/2012 Cantrell
2012/0233804 A1 9/2012 Studebaker et al.
2013/0255028 A1 10/2013 Pearlstein
2014/0245559 A1 9/2014 Pearlstein

OTHER PUBLICATIONS

Sapphire Scientific Co. rotating rug cleaning head (also presented as prior art Fig. 1 of patent application).
Rotovac Corp. prior art devices with carpet cleaning heads.

* cited by examiner

*Primary Examiner* — Dung Van Nguyen
(74) *Attorney, Agent, or Firm* — Patent Law Offices of Rick Martin, P.C.

(57) ABSTRACT

A rug cleaning head for a traditional rug cleaning application machine is improved. The spray apparatus remains prior art. The vacuum components on the underside of the cleaning head are improved with a focusing diverter arm or a pair of arms forming a "V". The arm or arms direct the wash water into a reduced size (about a one inch slot) vacuum inlet. The result is much more wash water is collected from the rug due to the combination of a higher speed (reduced size) vacuum inlet stream and the focusing diverter's urging all the wash water into the smaller vacuum inlet. An alternate embodiment uses separate spray/vacuum inlet assemblies on a star shaped hub.

22 Claims, 5 Drawing Sheets

WATER FOCUSING CLEANING HEAD

CROSS REFERENCE APPLICATIONS

This present application is a non-provisional claiming priority from provisional application Ser. No. 62/053,309 filed Sep. 22, 2014.

FIELD OF INVENTION

The present invention relates to improving the cleaning efficiency of a carpet cleaning head by focusing the wash water using a baffle into a smaller suction port.

BACKGROUND OF THE INVENTION

Thorough removal of debris from various flooring materials such as carpet can be a challenging task. Dry vacuuming can remove a portion of debris such as soil, etc.; however, a large portion of such material remains embedded within carpet fibers. A wide variety of mechanisms have been developed to provide additional cleaning such as shampoo processed, steam cleaning, soil absorption such as bonnet cleaning, soil extraction such as chemical cleaning done by ChemDry® and others, host cleaning where a particulate cleaning agent is dispersed and then vacuumed, and encapsulation using a crystalline cleaning agent. Each of these processes provides benefits ranging from cost, well established performance and market, and simplicity. However, most, if not all, current approaches within each area also suffer from various drawbacks such as excess water, extended dry times, chemical residue build-up, and/or poor soil removal.

Conventional wisdom in cleaning carpets is to clean deep and penetrate the carpet fibers to remove soil and debris. However, this often leaves excessive water remaining in the carpet which results in extended dry times. Further, chemical treatments typically leave at least a portion of the chemical in the carpet, often resulting in unacceptable residue build-up over time. Most chemical treatments are limited to cleaning the top quarter portion of the carpet piles, leaving the remainder substantially uncleaned. Some shampoo treatments and steam cleaning processes clean deeper into the carpet pile, but leave substantial amounts of water which can take as much as twelve hours or more to completely dry.

U.S. Pub. No. 2013/0255028 discloses a rotary cleaning device having a plurality of flush pad extractors that provide improved debris removal and reduced residual material. More specifically a rotary cleaning device can include a plurality of flush pad extractors which are oriented generally circumferentially about a common rotation axis. These unique flush pad extractors can include a fluid applicator and a vacuum member oriented behind the fluid applicator such that during operation of the device the fluid applicator contacts a surface to be cleaned prior to contact by the vacuum member.

The closest known prior art is shown in FIG. 1. A cleaning head 100 is made by Sapphire Scientific Co. Each wash water nozzle 101 has a spray pattern 102 characterized by a stream directed toward the centers of the cleaning head denoted 102A and a stream directed outbound from the center denoted 102B.

These nozzles 101 do not contact the rug. Following behind each nozzle 101 is a vacuum suction bar 103 having inlets 104. The vacuum suction bars 103 rest on the rug and support the weight of the applicator, wherein the U.S. Pub. No. 2012/0054981 and its applicator, cleaning device 10, is incorporated herein by reference. There is a spinning motor, a vacuum motor and a pressure source for the wash water.

Thus, the vacuum suction bar 103 brushes or agitates the rug and removes the excess wash water. Each vacuum suction bar 103 has a peripheral baffle 105 that has a leading tapered head 106. This tapered head 106 allows the cleaning head 100 to pass over obstacles such as an extension cord. Each peripheral baffle 105 extends down from the base B of the cleaning head 100 to block some of the spray pattern stream 102B. Thus, more of the wash water spray pattern 102 remains under the cleaning head 100.

The approximate length of the vacuum inlets 104 is 3.5 inches. This prior art device still leaves excess wash water on the rug, and the drying period can be a full day long.

As such, improved processes and systems which can be used to enhance deep cleaning of flooring materials such as carpet without leaving excessive water or chemical residue, and which are also economic, continue to be sought through ongoing development efforts.

SUMMARY OF THE INVENTION

The main aspect of the present invention is to provide an angled focusing baffle behind the spray nozzle so as to divert and focus the wash water directly into a reduced size vacuum inlet.

Another aspect of the present invention is to provide a "V" shaped focusing baffle to direct a wide spray pattern down into a small (nominally about one inch) vacuum port, thus pulling a large amount of wash water from the rug to accomplish a drying time of one to two hours.

Other aspects of this invention will appear from the following description and appended claims, reference being made to the accompanying drawings forming a part of this specification wherein like reference characters designate corresponding parts in the several views.

Forcing the water to the vacuum port from a wider point to a narrower point allows the vacuum port to be much smaller. Other rotary extractors have 3 inch vacuum slots or more. The present invention allows for increased vacuum power or water lift do to the smaller vacuum port. Example of this would be if you tried to suck water through a 1 inch straw a foot long you would not get much water. But if you suck through a ¼ inch straw it would be easy to get water. For example if a rotary cleaning head has 5-3 inch vacuum slots that extract water from the carpet the water lift or vacuum power will be less than the present invention that has 5-1 inch vacuum slots. This again is to take a 3 inch spray and forcing the water to 1 inch vacuum port with the present invention. Both are cleaning 3 inches of carpet as the head turns. This allows for better water extraction which means faster drying carpets. Most carpets dry in 1 to 2 hours.

The arm or arms extending from the vacuum port are any specific shape or size. They could be straight, wavy, curved etc. They could be made from metal plastic aluminum or many other materials. The purpose of the tool is to squeeze the water, that has been sprayed on the carpet, out of the carpet and force it over to the vacuum port. For example if the spray pattern that is being sprayed on the carpet is 3 inches wide then the tool could be made in a V shape with the front edge closest to the spray's 3 inches. Then as the head rotated the V shaped tool would squeeze the 3 inches of water from the carpet to a 1 inch vacuum port. You also could have different sized and shaped vacuum ports. Also you have any number of arms. For example you could have a diverting bar that only has 1 arm that covered the 3 inch spray pattern. The arm or arms also do not have to be attached to the vacuum inlet. The arm could just force the water over in front of the vacuum port. The diverting tool could be mounted differently than on a disc such as building a separate arm for each vacuum inlet. If the diverter tool didn't have any arms on it, and only extracted water from the width of the vacuum port, it would not work. The arms which are at a wider angel from the vacuum port are what make it work. You could have a narrower vacuum port and the arms at any angle so long as they are not perpendicular to the vacuum inlet as is done in the prior art shown in FIG. 1, and the invention will work.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE DRAWINGS

Figure 1:
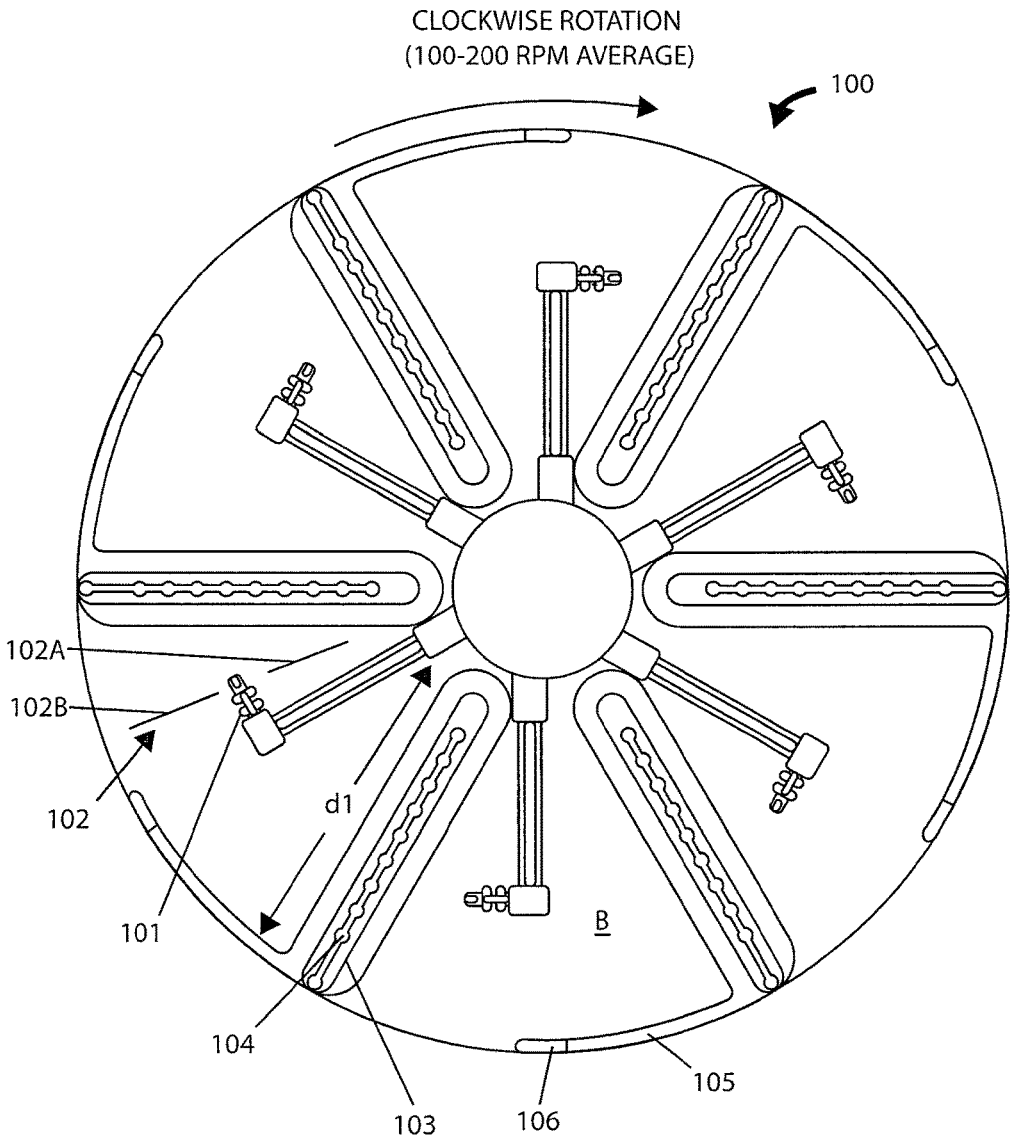
Fig. 1 (PRIOR ART)
FIG. 1 (prior art) is a bottom plan view of a cleaning head.
Figure 2:
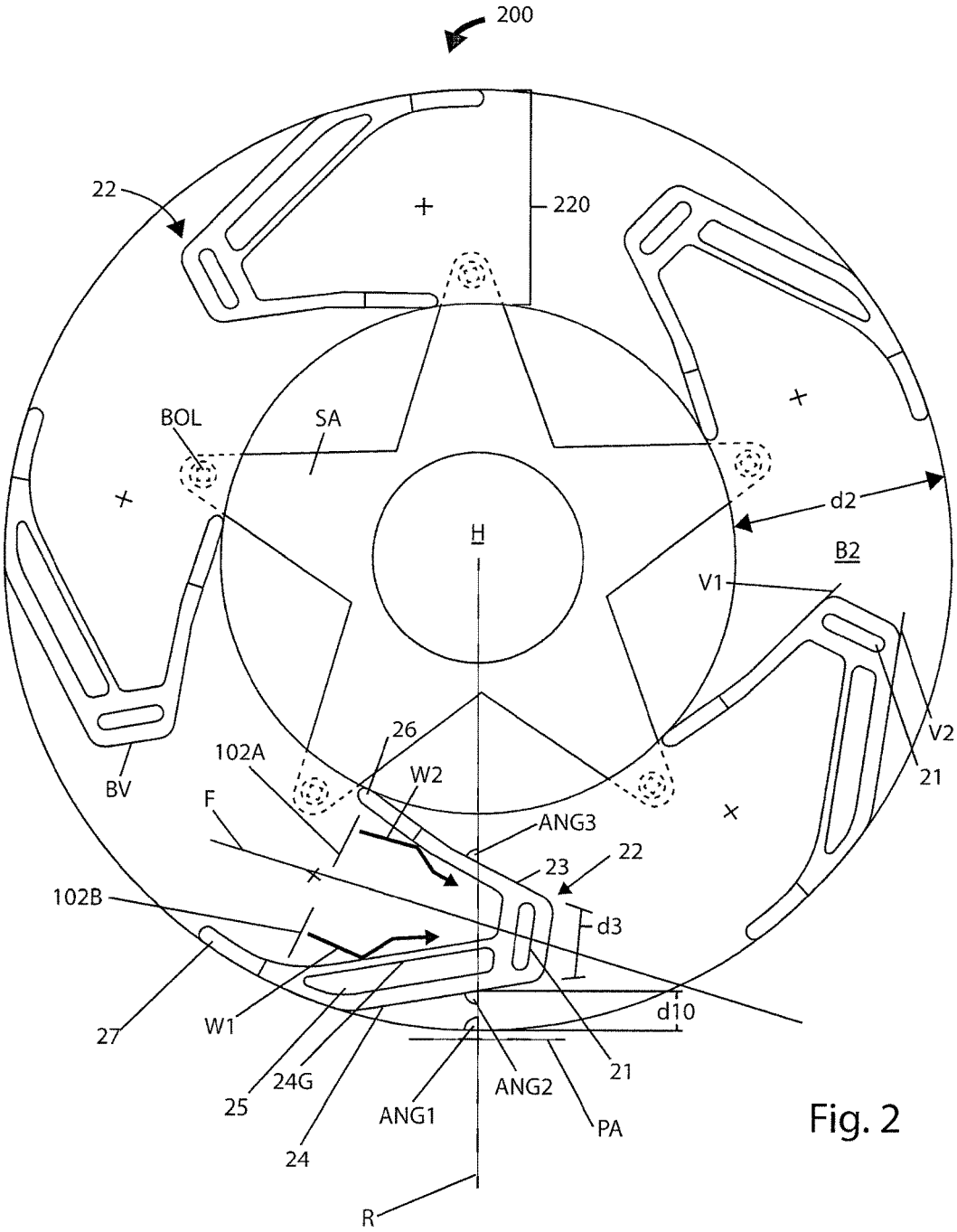
FIG. 2 is a bottom plan view of a first embodiment of the present invention cleaning head.

Referring now to FIG. 2 a cleaning head 20 rotates the same as the prior art cleaning head of FIG. 1. The nozzles (located at X) are the same as shown in FIG. 1. The star arms SA are powered by hub H and attach to the cleaning head 20 with bolts BOL in a known manner.

The base B2 can be a molded plastic piece including the focusing diverters 22. Distance d2 is nominally about 3.5 inches. Distance d3 is about one inch. It should not be greater than about 1.25 inch for optimal performance. The focusing diverter 22 has an opening 21 for the vacuum inlet with a best performance of d3=1.25 inch. The inner arm 23 has a tapered end 26. The outer arm 24 has a tapered end 27 as well as a groove 25 formed by outer arm segment 24G. Spray stream 102B travels in direction W1 so as to be diverted by outer arm segment 24G. Some wash water flows into groove 25. Distance d10 is at least about 0.25 inch, which is a distance from the perimeter to an outer edge of an outer diverter arm 24 near the vacuum inlet 21. A smaller distance d10 would result in a very short and ineffective diverter arm 24.

Critical to the present invention is that the angle from a radius R from the center H through the vacuum inlet 21, angle ANG 2, to the outer arm 24 and 24G is acute being about 85° or less. A simulated prior art arm PA is shown to have a 90° relationship to radius R. This prior art arm PA fails to divert wash water toward the vacuum inlet 21.

Arms 23 and 24G focus the wash water along an axis F which intersects the vacuum inlet 21 near its center. This embodiment shows arms 23 and 24G forming a "V" with a central axis between the legs of the "V" labeled F.

Other functional embodiments (not shown) could remove either arm 23 or arm 24/24G. Groove 25 is optional. Distance d3 is ideally about one inch. The vacuum inlet is nominally about 0.25 inch wide. This is about one third the area of prior art vacuum ports such as that shown in FIG. 1, vacuum inlet 104. With the same vacuum pressure supplied by the motor, the smaller sized inlet 21 increases the speed of the wash water through vacuum inlet 21. The non-obvious result is to vacuum much more water out of the rug resulting in a quicker drying time, using the same electric energy as the prior art applicator used in FIG. 1.

Ideally the vacuum inlet 21 should be sized not to exceed the diameter d3 of the base BV of the focusing diverter 22. In any case the vacuum inlet 21 cannot extend beyond the diverter arms as shown by lines V1 and V2.

Figure 3:
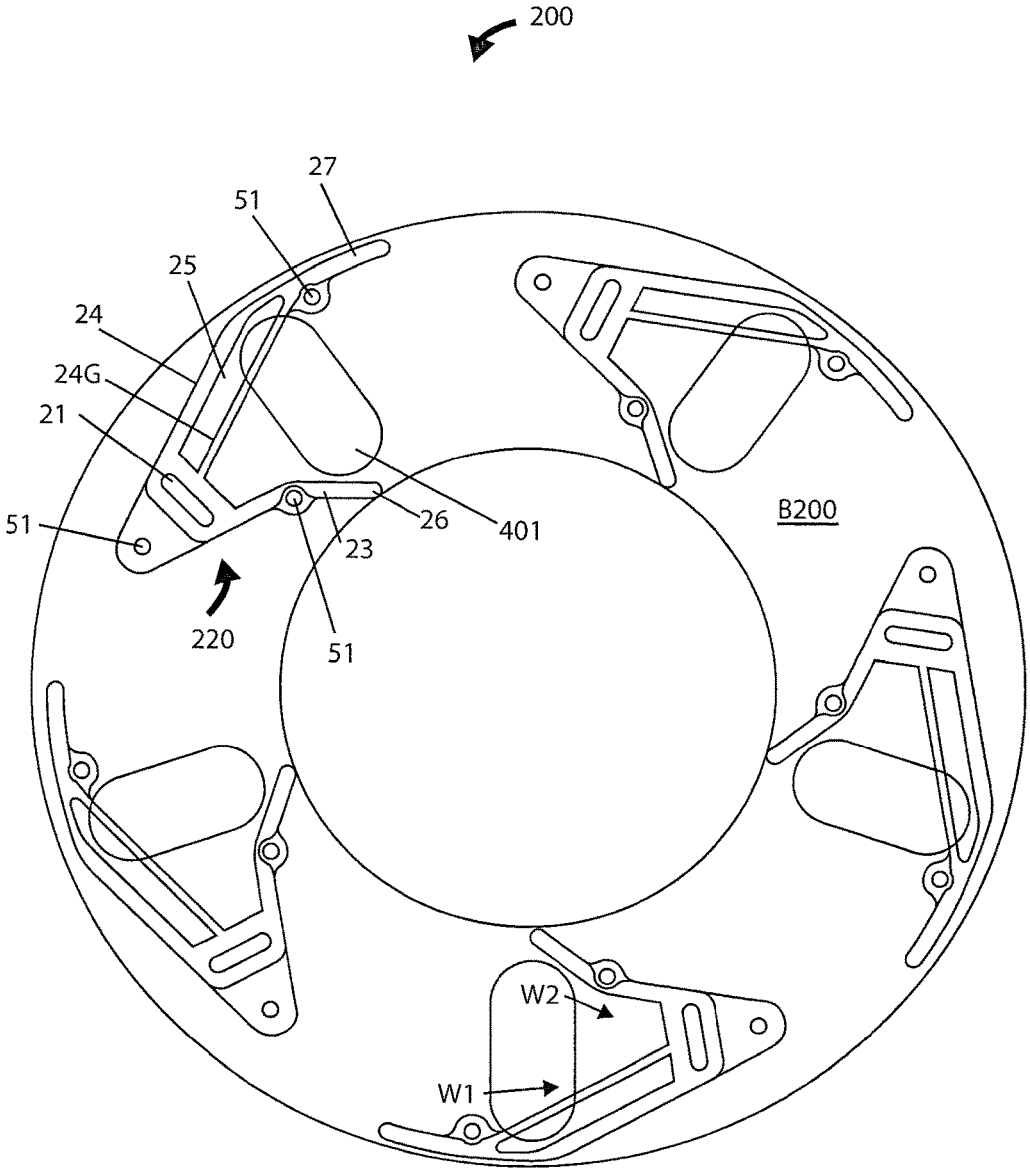
FIG. 3 is a bottom plan view of a second embodiment of the present invention cleaning head.

Referring next to FIG. 3 the flow dynamics are the same as in FIG. 2. Here the focusing diverter 220 of cleaning head 200 is attached to base B200 via bolt holes 51 and bolts (not shown). Vacuum slot 21 is the same.

Figure 4:
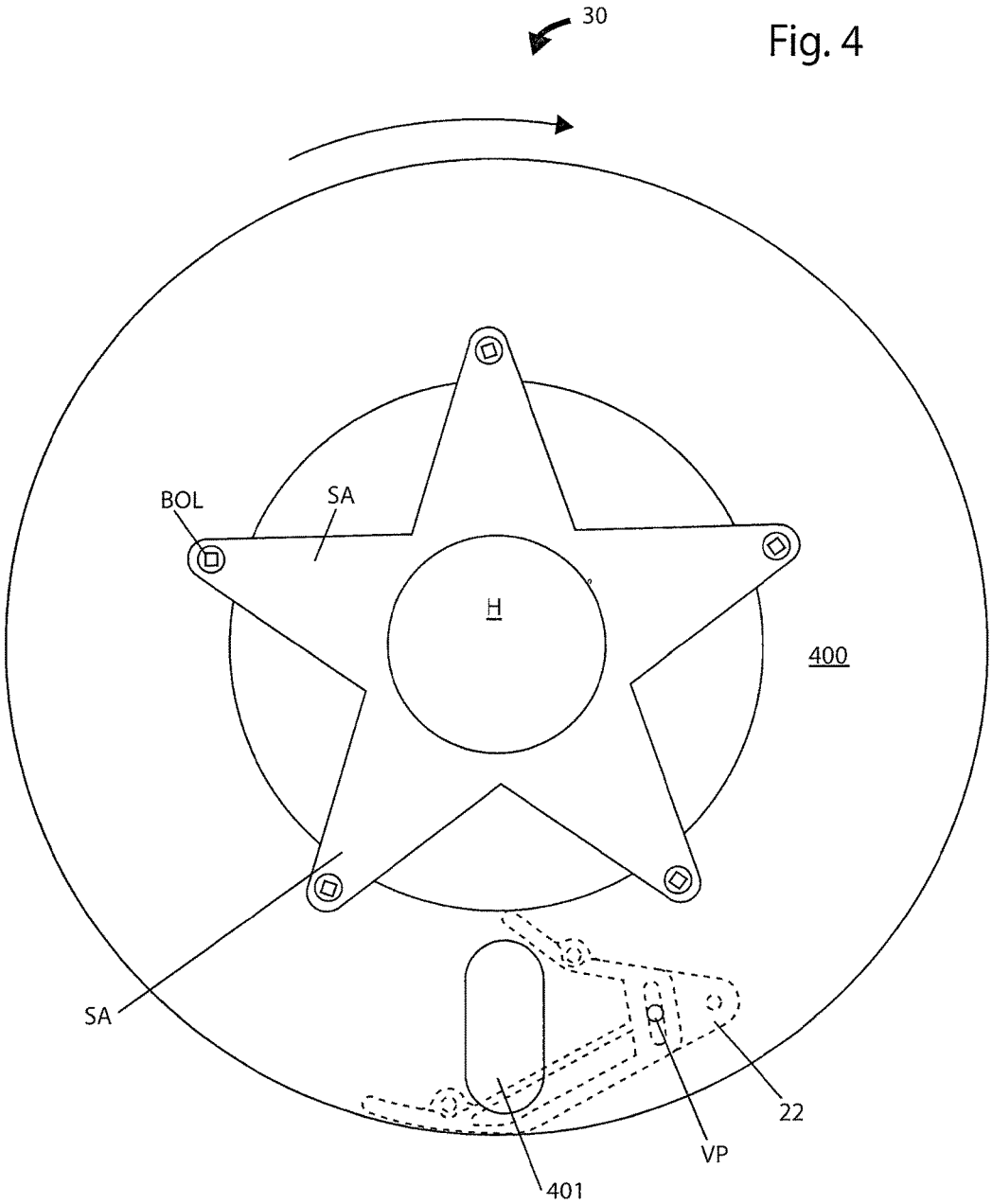
FIG. 4 is a top plan view of the present invention cleaning head of either FIG. 2 or 3.

Referring next to FIG. 4 the cleaning head 20 has a top 400 that uses a prior art star STAR with legs SA. A powered hub (not shown) attached in a known manner to the star STAR. The focusing diverter 22 is shown in dots on the bottom surface B2 of the cleaning head 20. The hose connection VP for the vacuum hose (not shown) is shown. A nozzle opening 401 is shown.

Figure 5:
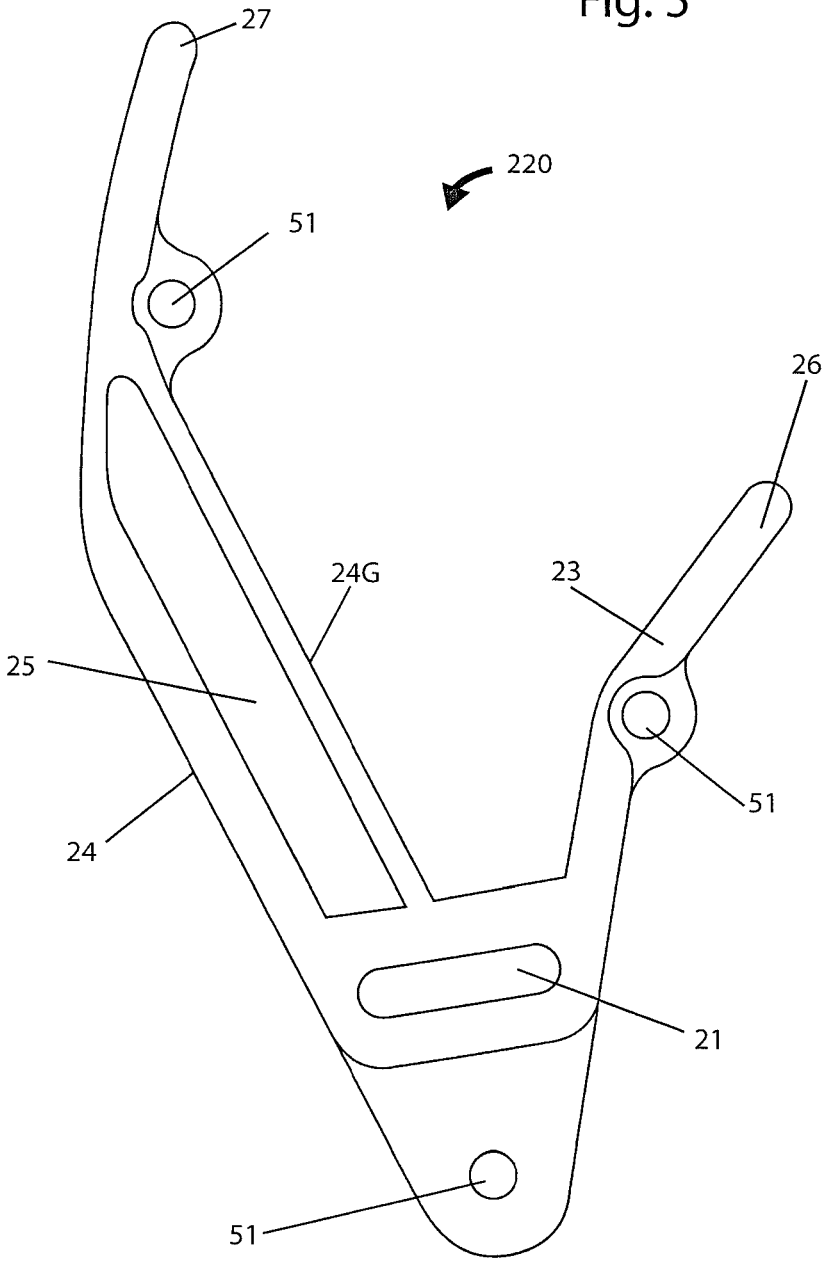
FIG. 5 is a bottom plan view of the focusing V shaped baffle shown in FIG. 3.

FIG. 5 shows a stand alone focusing diverter 220 as seen in FIG. 3.

Although the present invention has been described with reference to the disclosed embodiments, numerous modifications and variations can be made and still the result will come within the scope of the invention. No limitation with respect to the specific embodiments disclosed herein is intended or should be inferred. Each apparatus embodiment described herein has numerous equivalents.

I claim:

1. A rotary carpet cleaning head comprising:

a plate shaped base having a top surface and a bottom surface;

said plate shaped base having a connection for a powered hub which rotates the plate shaped base;

a plurality of wash water spray nozzles attached to the plate shaped base which when in use spray wash water into a carpet to be cleaned;

a first diverter arm attached to the bottom surface behind a first wash water spray nozzle so as to form an acute angel smaller than or equal to about 85° relative to a radius axis from a center of the plate shaped base through a vacuum inlet;

said vacuum inlet cannot extend beyond the first diverter arm;

said first diverter arm located between the center of the plate shaped base and the vacuum inlet and the acute angle measured inbound from the first diverter arm;

said first diverter arm extending from the first wash water spray nozzle to the vacuum inlet;

said first diverter arm having a height to rest on the carpet to be cleaned, wherein a support for a weight of a powered applicator machine is supported by the first diverter arm; and said vacuum inlet has an opening cross sectional area of less than about one half a square inch.

2. The cleaning head of claim 1 further comprising a second diverter arm attached to the bottom surface behind the first wash water spray nozzle so as to form a "V" shape relative to the first diverter arm, said second diverter arm having a height the same as the first diverter arm, and said "V" shape having a central axis aligned with the vacuum inlet.

3. The cleaning head of claim 2, wherein the second diverter arm as an inner arm segment that forms a groove between itself and the second diverter arm.

4. The cleaning head of claim 2, wherein each of the first and second diverter arms have a tapered height leading tip in the direction of the rotation of the cleaning head.

5. The cleaning head of claim 4, wherein each of the first and second diverter arms are attached to the plate shaped base with fasteners.

6. The cleaning head of claim 4, wherein each of the first and second diverter arms are formed in a mold concurrent with the plate shaped base.

7. The cleaning head of claim 2, wherein the second diverter arm intersects an outer edge of the vacuum inlet at least about 0.25 inch from a periphery of the plate shaped base.

8. The cleaning head of claim 1, wherein the vacuum inlet is sized as a slot along a radius arm, said slot having a radius length of about 1.25 inch or less and a width of about one fourth inch.

9. The cleaning head of claim 1, wherein the first diverter arm has a tapered height leading tip in a direction of a rotation of the cleaning head.

10. A rotary carpet cleaning head comprising:

a plate shaped base having a top surface and a bottom surface;

said plate shaped base having a connection for a powered hub which rotates the plate shaped base;

a plurality of wash water spray nozzles attached to the plate shaped base which when in use sprays wash water into a carpet to be cleaned;

a first diverter arm attached to the bottom surface behind a first wash water spray nozzle so as to form an acute angle smaller than or equal to about 85° relative to a radius axis from a center of the plate shaped base through a vacuum inlet;

said acute angle measured outbound from the first diverter arm;

said first diverter arm located between a periphery of the plate shaped base and the vacuum inlet;

said acute angle formed between the periphery and an end of the first diverter arm that contacts the periphery;

said first diverter arm extending from the first wash water spray nozzle to the vacuum inlet;

said first diverter arm having a height to rest on the carpet to be cleaned, wherein a support for a weight of a powered applicator machine is supported by the first diverter arm; and said vacuum inlet has an opening cross sectional area of less than about one half a square inch.

11. The cleaning head of claim 10 further comprising a second diverter arm attached to the bottom surface behind the first wash water spray nozzle so as to form a "V" shape relative to the first diverter arm, said second diverter arm having a height the same as the first diverter arm; and said "V" shape having a central axis aligned with the vacuum inlet.

12. The cleaning head of claim 11, wherein the first diverter arm as an inner arm segment that forms a groove between itself and the first diverter arm.

13. The cleaning head of claim 11, wherein each of the first and second diverter arms have a tapered height leading tip in the direction of the rotation of the cleaning head.

14. The cleaning head of claim 13, wherein each of the first and second diverter arms are attached to the plate shaped base with fasteners.

15. The cleaning head of claim 13, wherein each of the first and second diverter arms are formed in a mold concurrent with the plate shaped base.

16. The cleaning head of claim 10, wherein the vacuum inlet is sized as a slot along a radius arm, said slot having a radius length of about one inch and a width of about one fourth inch.

17. The cleaning head of claim 10, wherein the first diverter arm has a tapered height leading tip in a direction of a rotation of the cleaning head.

18. A rotary carpet cleaning head comprising:

a rotating spray and vacuum inlet assembly;

said assembly having a connection means to a powered hub functioning to allow the powered hub to rotate the assembly;

a wash water spray nozzle attached to the assembly which when in use sprays wash water into a carpet to be cleaned;

a V shaped focusing diverter having a height to rest on the carpet to be cleaned;

wherein said V shaped focusing diverter diverts wash water from the wash water spray nozzle from a point inbound and along a radius of the cleaning head and from the wash water spray nozzle and a point at a periphery of the cleaning head into a vacuum inlet on the assembly as the assembly is rotating in use;

said vacuum inlet sized to be equal or less in length than a distance between an inner edge of a pair of arms at a top nozzle end of the V shape of the V shaped focusing diverter means; and wherein a support for a weight of a powered applicator machine is supported by the V shaped focusing diverter.

19. The cleaning head of claim 18, wherein the vacuum inlet nozzle has an opening cross sectional area of less than about one half square inch, and the rotating spray and vacuum inlet assembly further comprises at least two assemblies.

20. The cleaning head of claim 19, wherein the vacuum inlet has a slot length of equal to or less than about 1.25 inches.

21. A rotary carpet cleaning head comprising:

a plate shaped base having a top surface and a bottom surface;

said plate shaped base having a connection for a powered hub which rotates the plate shaped base;

a plurality of wash water spray nozzles attached to the plate shaped base which when in use sprays wash water into a carpet to be cleaned;

a first diverter arm attached to the bottom surface having a nozzle end about aligned along a radius of the plate shaped base and the wash water spray nozzle;

said nozzle end having a height to rest on the carpet to be cleaned, wherein a weight of a powered applicator machine is supported by the first diverter arm;

said nozzle end further comprising a tapered leading edge extending forward from the wash water spray nozzle to the plate shaped base at a peripheral edge;

said first diverter arm extending from the peripheral edge inward and having an outside edge which is outbound from a vacuum inlet; and wherein water from the wash water spray nozzle is diverted from the nozzle end inbound into the vacuum inlet.

22. The rotary carpet cleaning head of claim 21 further comprising a second diverter arm forming a V with the first diverter arm so that an inner edge of the second diverter arm is inbound from the vacuum inlet.

* * * * *